US005533315A

United States Patent [19]

Van Dam et al.

[11] Patent Number: 5,533,315

[45] Date of Patent: Jul. 9, 1996

[54] CLOSURE CHECKING APPARATUS FOR BAGGED GOODS

[75] Inventors: Aaldert C. Van Dam; Kenneth C. Honings, both of Richmond, Va.

[73] Assignee: Blueprint Automation, Inc., Richmond, Va.

[21] Appl. No.: 522,732

[22] Filed: Sep. 1, 1995

[51] Int. Cl.[6] ..... B65B 57/04; B07C 5/02

[52] U.S. Cl. ..... 53/53; 53/77

[58] Field of Search ..... 53/53, 76, 75, 53/77, 54, 52, 504, 138.7, 138.8, 138.4, 138.3, 284.7; 209/597

[56] References Cited

U.S. PATENT DOCUMENTS

| | | | |
|---|---|---|---|
| 3,606,014 | 9/1971 | Linn | 53/53 X |
| 4,011,155 | 3/1977 | Feurstein et al. | 53/53 X |
| 4,559,754 | 12/1985 | Bacon | 53/53 |
| 4,916,883 | 4/1990 | Focke | 53/53 |
| 4,984,409 | 1/1991 | Focke | 53/53 |
| 5,375,390 | 12/1994 | Frigo et al. | 53/75 X |

*Primary Examiner*—James F. Coan

[57] ABSTRACT

An apparatus checks a closure on an end of a bag having loosely packed goods contained therein. A first conveyor extends the length of the apparatus. Second and third conveyors are positioned adjacent one side of the first conveyor. A gap is defined between the second conveyor and the third conveyor. Adjacent portions of the first conveyor and second conveyor are coplanar to define a first surface moving in the same direction at the same speed that fully supports the bag moving thereon. Adjacent portions of the first conveyor and the third conveyor are coplanar to define a second surface moving in the same direction at the same speed as the first surface that also fully supports the bag moving thereon. The first conveyor partially supports the bag such that the end thereof and a portion of the loosely packed goods contained in the bag are unsupported by the first conveyor in the area of the gap. A plate is mounted above the first conveyor for applying a downward friction pressure to the bag as the bag moves on the first conveyor in the area of the gap. As a result, the bag is caused to rotate and a portion of the goods fall out of the end of the bag if the closure is not secure. A detector is arranged in the area of the gap for detecting any goods falling out of the end of the bag. An ejector is coupled to the detector for removing any failed bag from the second surface in response to a reject signal from the detector.

15 Claims, 4 Drawing Sheets

CLOSURE CHECKING APPARATUS FOR BAGGED GOODS

FIELD OF THE INVENTION

The invention relates generally to automated package-handling equipment, and more particularly to an automated closure checking apparatus for checking the integrity of a closure formed at one end of a bag containing loosely packed goods such as bagels, rolls, donuts, cookies, popcorn, candies, etc.

1. Background of the Invention

A variety of foods are packed loosely in bags that are sealed or closed by a twist tail or other means known in the art for closing bags. Currently, the sealed bags are simply checked visually during the packaging process. However, this is time consuming and ineffective in many instances. Specifically, a bag's seal or closure can look satisfactory but still fail as the package undergoes additional handling.

2. Summary of the Invention

Accordingly, it is an object of the present invention to provide an automated apparatus for checking the closure on one end of a bag filled with loosely packed goods.

Another object of the present invention is to provide an automated apparatus that detects and removes defectively closed bags of goods.

Other objects and advantages of the present invention will become more obvious hereinafter in the specification and drawings.

In accordance with the present invention, an apparatus checks a closure on an end of a bag having loosely packed goods contained therein. A first conveyor has a leading edge and a trailing edge. A second conveyor has a leading edge and a trailing edge, and is positioned adjacent one side of the first conveyor. The trailing edge of the second conveyor resides between the leading edge of the first conveyor and the trailing edge of the first conveyor. Adjacent portions of the first conveyor and second conveyor are coplanar to define a first surface moving in the same direction at the same speed that fully supports the bag moving thereon. A third conveyor has a leading edge and a trailing edge, and is positioned adjacent the one side of the first conveyor. The leading edge of the third conveyor resides between the leading edge of the first conveyor and the trailing edge of the first conveyor such that a gap is defined between the trailing edge of the second conveyor and the leading edge of the third conveyor. Adjacent portions of the first conveyor and the third conveyor are coplanar to define a second surface moving in the same direction at the same speed as the first surface. The second surface fully supports the bag moving thereon. The first conveyor partially supports the bag such that the end thereof and a portion of the loosely packed goods contained in the bag are unsupported by the first conveyor in the area of the gap. A pressure or friction plate is mounted above the first conveyor for applying a downward pressure to the bag causing the bag to rotate as the bag moves on the first conveyor in the area of the gap. As a result, a portion of the goods fall out of the end of the bag if the closure is not secure. A detector is arranged in the area of the gap for detecting any goods falling out of the end of the bag when the closure is not secure. The detector provides a reject signal indicative of such detection. An ejector is coupled to the detector for removing any failed bag from the second surface in response to the reject signal.

DETAILED DESCRIPTION OF THE INVENTION

Figure 1:
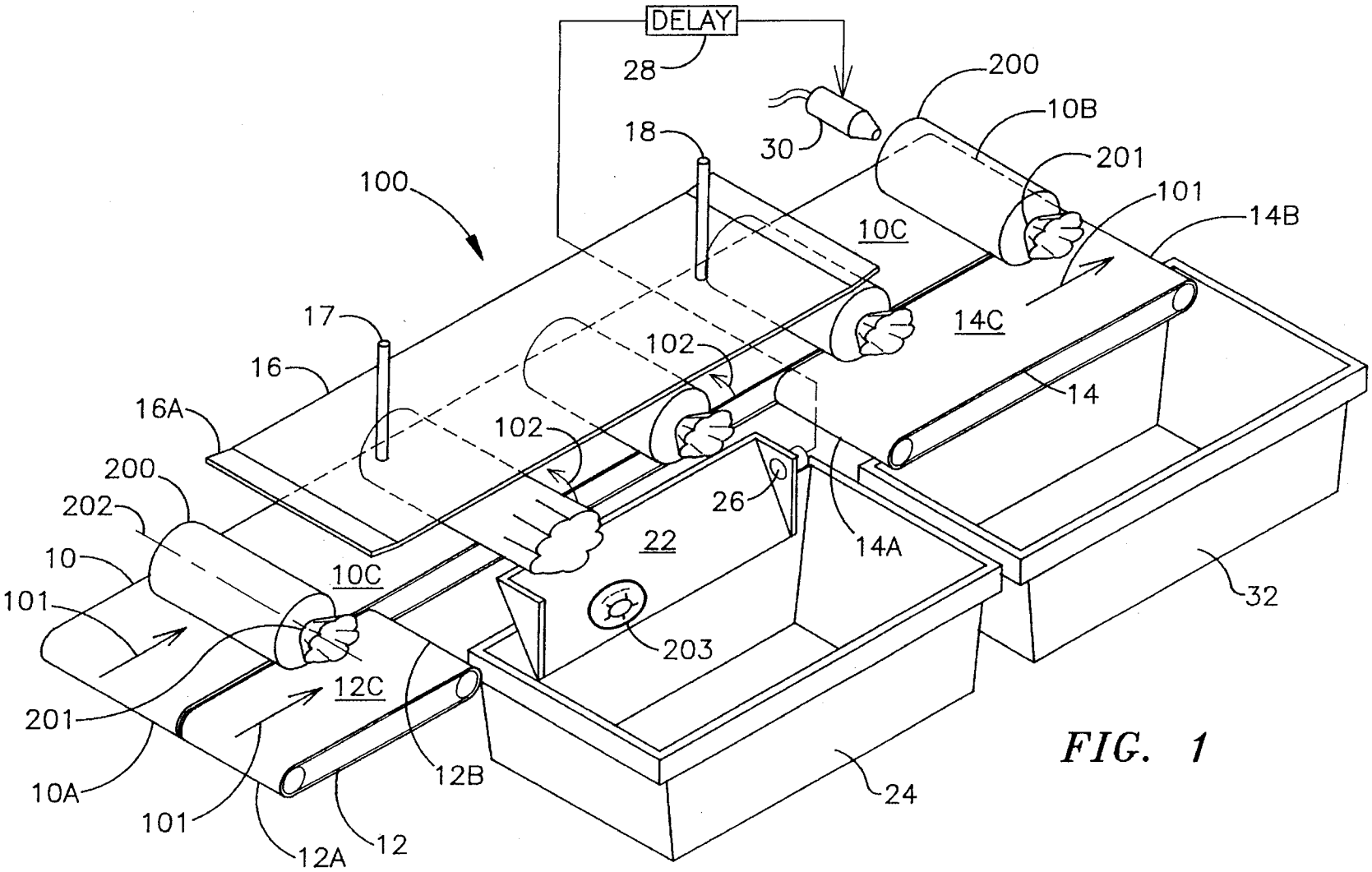
FIG. 1 is a schematic view of the closure checking apparatus according to the present invention.

Referring now to the drawings, and more particularly to FIG. 1, the closure checking apparatus of the present invention is shown and referenced generally by numeral 100. In general, apparatus 100 is defined by a divided-belt conveyor having three moving conveyor sections. A first section delivers bagged goods to a second section where the closure is automatically checked. The second section delivers the bagged goods, having both good and failed closures, to a third section where the bags with failed closures are automatically removed from the conveying apparatus while the bags with good closures are allowed to continue to the next operation in the packaging process.

More specifically, apparatus 100 uses three conveyors to transport bagged goods. First conveyor 10 extends the entire length of apparatus 100. Second conveyor 12 is typically shorter in length than first conveyor 10 and is arranged to have leading edge 12A aligned with leading edge 10A of first conveyor 10. Third conveyor 14 is also typically shorter in length than first conveyor 10 and is arranged to have leading edge 14A spaced apart from trailing edge 12B of second conveyor 12 on the same side of first conveyor 10 to form a gap therebetween. Trailing edge 14B of third conveyor 14 is aligned with trailing edge 10B of first conveyor 10.

Top surfaces 10C and 12C of first conveyor 10 and second conveyor 12, respectively, are coplanar to define a moving surface. Similarly, top surfaces 10C and 14C of first conveyor 10 and third conveyor 14, respectively, are also coplanar to define another moving surface. In a manner that will be described further below, first conveyor 10, second conveyor 12 and third conveyor 14 are all moved at the same speed in the same direction. Direction of travel for all three conveyors is indicated by arrows 101.

In the area of the gap between trailing edge 12B and leading edge 14A, pressure or friction plate 16 is mounted above first conveyor 10. The height of pressure plate 16 above top surface 10C is adjusted by means of height adjustment screws 17 and 18 (only two are shown in FIG. 1 for ease of illustration) based on the type and size of bagged goods 200 being checked by apparatus 100. In general, the height of pressure plate 16 is set so as to apply a slight downward pressure on bagged goods 200 as they pass thereunder. Since pressure plate 16 is stationary with respect to first conveyor 10, the pressure generates a friction force from above that causes bagged goods 200 to undergo a rolling motion (as indicated by arrows 102) as first conveyor 10 continues to move. Pressure plate 16 has leading edge 16A that is arranged perpendicular to direction of travel 101 and can be angled slightly up and away from first conveyor 10. The space between pressure plate 16 and first conveyor 10 is slightly less than the diameter of the rounded bagged goods 200. The tapered inlet opening provided by leading edge 16A defines a space between first conveyor 10 and the maximum opening of leading edge 16A that is greater than the diameter of bagged goods 200. So configured, bagged goods 200 are forced into a preferred alignment by pressure plate 16 so that any bags that come in at an angle are caused to be straightened out.

Bagged goods 200 are placed onto the moving surface formed by first conveyor 10 and second conveyor 12. The goods contained in each bag can be any loosely packed goods and, for purpose of the remainder of the description, will be assumed to be bagels. However, the present invention will work for any similar loosely packed, bagged goods that are sealed on one end of the bag. Bagged goods 200 are typically passed onto apparatus 100 generally immediately after an automatic bagging operation which forms closure 201 in one end of each bag by means of a twist tail or other bag closing means well known in the art. Each of bagged goods 200 is positioned such that the majority of each of bagged goods 200 resides on first conveyor 10 while a small portion of each bagged goods 200 (to include the end of the bag having closure 201) is situated on second conveyor 12.

Bagged goods 200 typically have longitudinal axis 202 passing through closure 201. As bagged goods 200 approach the section of apparatus 100 defined by first conveyor 10 and pressure plate 16, bagged goods 200 are funneled into a preferred alignment (e.g., longitudinal axis 202 perpendicular to direction of travel 101) by leading edge 16A. Properly aligned, the end of bagged goods 200 having closure 201 becomes unsupported as bagged goods run off trailing edge 12B of second conveyor 12. As described above, pressure plate 16 causes bagged goods 200 to undergo a rolling motion as first conveyor 10 continues to move while pressure plate 16 is stationary.

If closure 201 is adequate, bagged goods 200 continue on to the moving surface formed by first conveyor 10 and third conveyor 14 where bagged goods 200 are once again fully supported for passage onto the next operation (not shown). If, however, closure 201 is not adequate or fails, the rolling motion causes at least the unsupported portion of the goods, e.g., bagel 203, to tumble out of the open-ended bag as shown in FIG. 1. The amount of rolling motion required to cause the goods to tumble out of a failed closure depends on the type of goods contained in the bag. For example, for rollable goods such as bagels, rolls, donuts, etc., generally 1.5 rotations of the bagged goods is sufficient to cause goods to tumble out of the bag. However, for other goods such as popcorn or round candies, the rolling motion caused by pressure plate 16 and first conveyor 10 need only be slight to cause the goods to fall out a failed closure. Preferably, approximately 4 rotations are used when bagged goods 200 contain bagels.

To catch the goods falling out of failed bag closures, chute 22 funnels the goods falling out of the failed bags, e.g., bagel 203, into collection bin 24. Chute 22 is also provided with a detection system to detect when such failure occurs. By way of example, chute 22 can have optical sensor 26 mounted on one end (or both ends) thereof. Sensor 26 generates a reject signal each time falling goods pass thereby which is indicative of a bag failure. Since it is desirable to automatically reject any such failed bags, the reject signal is passed to automatic reject station of apparatus 100. This rejection operation is most easily carried out after bagged goods 200 have passed pressure plate 16. Accordingly, the reject signal generated by optical sensor 26 is delayed by delay 28 which takes into account the location of the rejection station and speed of travel of conveyor 10. Delay 28 passes the reject signal to activate blow-off or ejector 30 which can be a pneumatic blower. Other forms of ejection known in the art can also be used such as mechanical pushers, mechanical extractors, etc. To catch the rejected ones of bagged goods 200, rejection bin 32 is provided in the vicinity of ejector 30.

Figure 2:
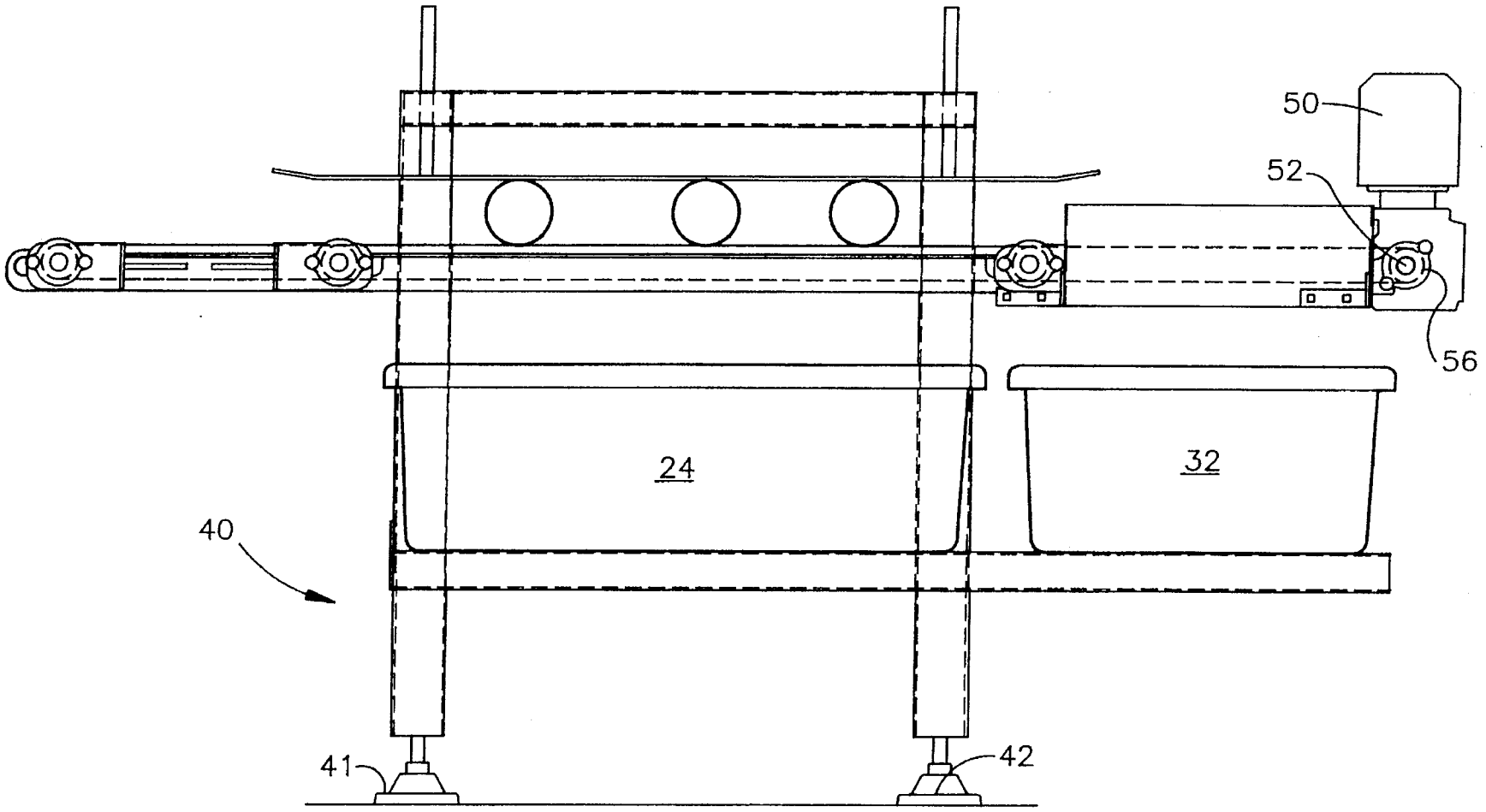
FIG. 2 is a side view of an implementation of the closure checking apparatus.
Figure 3:
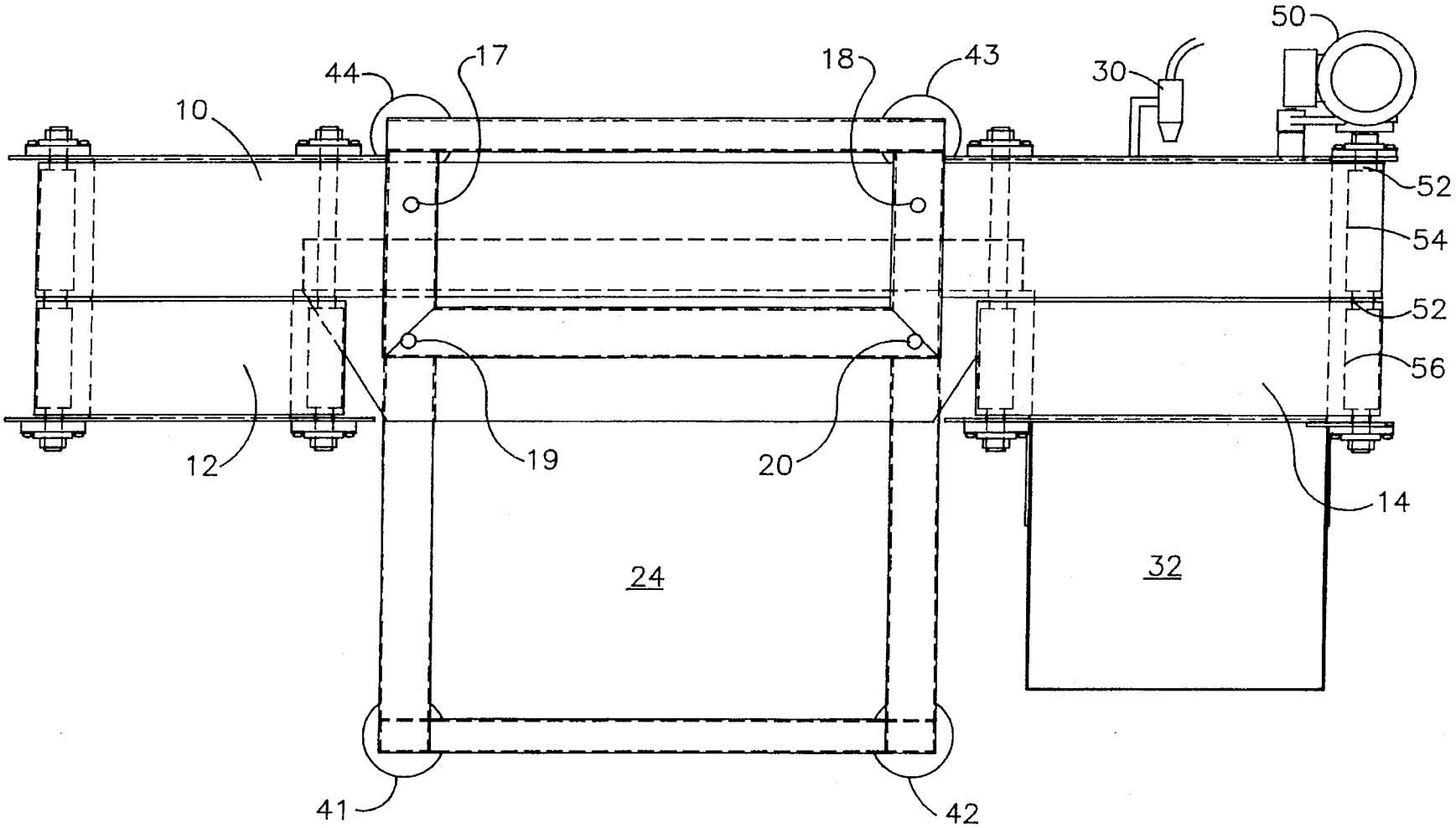
FIG. 3 is a top view of the implementation shown in FIG. 2.
Figure 4:
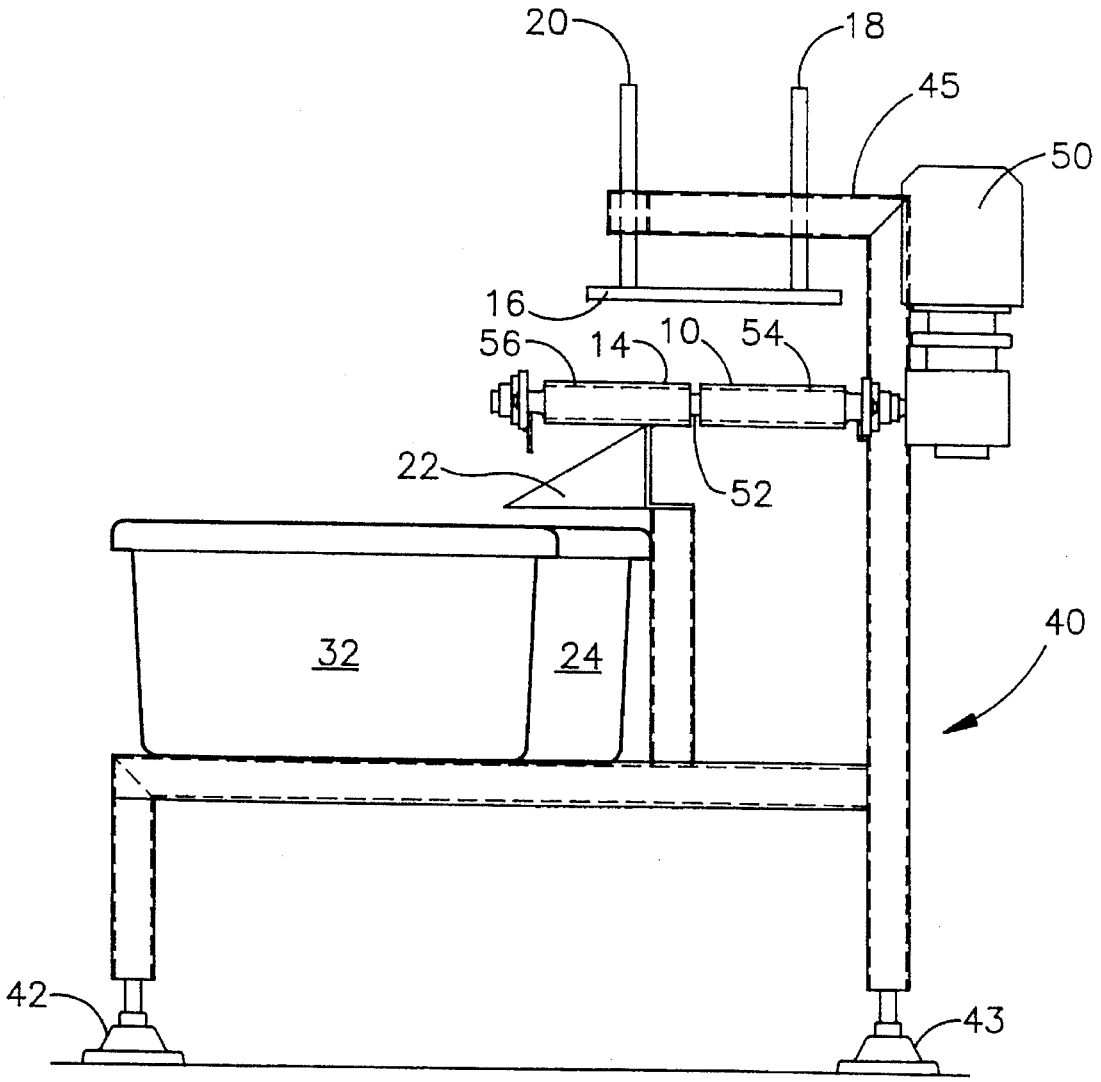
FIG. 4 is an end view of the implementation shown in FIG. 2.

While the present invention can be physically implemented in a variety of fashions, one stand-alone embodiment will be described with simultaneous reference to the schematic views shown in FIGS. 2, 3 and 4. Elements in common with FIG. 1 will use the same reference numerals and will generally not be discussed further. Apparatus 100 is supported on four-legged rigid frame 40. Each of the four support legs is typically provided with adjustable feet 41–44 for leveling apparatus 100. Frame 40 further includes L-support 45 for supporting pressure plate 16 by means of height adjusting screws 17–20. The motive force for first conveyor 10, second conveyor 12 and third conveyor 14 can originate form one motor 50 having common drive shaft 52 that simultaneously rotates drive rollers 54 and 56 which drive first conveyor 10 and third conveyor 14. Second conveyor 12 is mechanically linked to first conveyor 10 by common shafts so that second conveyor 12 runs at the same speed as first conveyor 10 and third conveyor 14.

The advantages of the present invention are numerous. Bagged closures are checked automatically and failed bags are automatically rejected. The apparatus can easily be implemented in a stand-alone configuration for insertion into an automated packaging line. The simple operating principles employed by the present invention make the implementation thereof cost effective for a wide variety of bagged goods Although the invention has been described relative to a specific embodiment thereof, there are numerous variations and modifications that will be readily apparent to those skilled in the art in the light of the above teachings. For example, pressure plate 16 preferably has rubber strips adhered to its pressure applying surface to increase friction in order to prevent the bagged goods from slipping against pressure plate 16. The length of pressure plate 16 can be tailored to impart the desired amount of rolling motion to the bagged goods based upon the types of goods in the bags. It is therefore to be understood that, within the scope of the appended claims, the invention may be practiced other than as specifically described.

What is claimed as new and desired to be secured by Letters Patent of the United States is:

1. An apparatus for checking a closure on an end of a bag having loosely packed goods contained therein, comprising:

a first conveyor section for fully supporting said bag during movement on said first conveyor section;

a second conveyor section coupled to said first conveyor section for receiving said bag from said first conveyor section, said second conveyor section partially supporting said bag such that said end and a portion of said loosely packed goods contained in said bag are unsupported by said second conveyor section during movement on said second conveyor section;

a plate mounted above said second conveyor section for applying a downward pressure to said bag as said bag moves on said second conveyor section, wherein said portion of said goods fall out of said end if said closure is not secure; and a detector arranged in relation to said second conveyor section for detection of said portion of said loosely packed goods falling out of said end when said closure is not secure, said detector providing a reject signal indicative of said detection.

2. An apparatus as in claim 1 further comprising:

a third conveyor section coupled to said second conveyor section for receiving said bag from said second conveyor section and for fully supporting said bag during movement on said third conveyor section; and an ejector coupled to said detector for removing said bag from said third conveyor section in response to said reject signal.

3. An apparatus as in claim 1 further comprising a collection bin adjacent said second conveyor section for receiving said portion of said loosely packed goods falling out of said end when said closure is not secure.

4. An apparatus as in claim 2 further comprising a reject bin adjacent said third conveyor section for receiving said bag so removed from said third conveyor section.

5. An apparatus as in claim 1 wherein said plate has a leading edge substantially perpendicular to movement of said first conveyor section, said leading edge being bent on an angle away from said second conveyor section.

6. An apparatus as in claim 1 wherein said bag has a longitudinal axis substantially perpendicular to movement of said second conveyor section, and wherein said plate is of sufficient length to cause to said bag to rotate at least 1.5 times about said longitudinal axis.

7. An apparatus as in claim 1 wherein said detector is an optical detector.

8. An apparatus for checking a closure on an end of a bag having loosely packed goods contained therein, comprising:

a first conveyor having a leading edge and a trailing edge;

a second conveyor having a leading edge and a trailing edge, said second conveyor positioned adjacent one side of said first conveyor such that said trailing edge of said second conveyor resides between said leading edge of said first conveyor and said trailing edge of said first conveyor, wherein adjacent portions of said first conveyor and said second conveyor are coplanar to define a first surface moving in the same direction at the same speed, said first surface fully supporting said bag moving thereon;

a third conveyor having a leading edge and a trailing edge, said third conveyor positioned adjacent said one side of said first conveyor such that said leading edge of said third conveyor resides between said leading edge of said first conveyor and said trailing edge of said first conveyor and such that a gap is defined between said trailing edge of said second conveyor and said leading edge of said third conveyor, wherein adjacent portions of said first conveyor and said third conveyor are coplanar to define a second surface moving in the same direction at the same speed as said first surface, said second surface fully supporting said bag moving thereon;

said first conveyor partially supporting said bag such that said end and a portion of said loosely packed goods contained in said bag are unsupported by said first conveyor in the area of said gap;

a plate mounted above said first conveyor for applying a downward pressure to said bag as said bag moves on said first conveyor in the area of said gap, wherein said portion of said loosely packed goods fall out of said end if said closure is not secure;

a detector arranged in relation to said first conveyor in the area of said gap for detection of said portion of said loosely packed goods falling out of said end when said closure is not secure, said detector providing a reject signal indicative of said detection; and an ejector coupled to said detector for removing said bag from said second surface in response to said reject signal.

9. An apparatus as in claim 8 wherein said leading edge of said first conveyor and said leading edge of said second conveyor are aligned with one another.

10. An apparatus as in claim 8 wherein said trailing edge of said first conveyor and said trailing edge of said third conveyor are aligned with one another.

11. An apparatus as in claim 8 further comprising a collection bin adjacent said first conveyor in the area of said gap for receiving said portion of said loosely packed goods falling out of said end when said closure is not secure.

12. An apparatus as in claim 8 further comprising a reject bin adjacent said second surface for receiving said bag so removed from said second surface.

13. An apparatus as in claim 8 wherein said plate has a leading edge substantially perpendicular to movement of said first conveyor, said leading edge being bent on an angle away from said first conveyor.

14. An apparatus as in claim 8 wherein said bag has a longitudinal axis substantially perpendicular to movement of said first conveyor, and wherein said plate is of sufficient length to cause to said bag to rotate at least 1.5 times about said longitudinal axis.

15. An apparatus as in claim 8 wherein said detector is an optical detector.

* * * * *